United States Patent [19]

Pai

[11] 4,442,192

[45] Apr. 10, 1984

[54] PHOTORESPONSIVE DEVICE CONTAINING AN ELECTRON DONATING LAYER

[75] Inventor: Damodar M. Pai, Fairport, N.Y.

[73] Assignee: Xerox Corporation, Stamford, Conn.

[21] Appl. No.: 385,628

[22] Filed: Jun. 7, 1982

[51] Int. Cl.[3] ..... G03G 5/00; G03G 5/04

[52] U.S. Cl. ..... 430/59; 430/65; 430/66

[58] Field of Search ..... 430/58, 59, 66, 67

[56] References Cited

U.S. PATENT DOCUMENTS

| | | | |
|---|---|---|---|
| 3,840,368 | 10/1974 | Ikeda et al. | 96/1.5 |
| 3,856,548 | 12/1974 | Taylor et al. | 117/6 |
| 3,966,471 | 6/1976 | Hasegawa et al. | 96/1.5 |
| 4,088,483 | 5/1978 | Isono et al. | 96/1.5 R |
| 4,148,637 | 4/1979 | Kubota et al. | 96/1.5 N |
| 4,265,990 | 3/1981 | Stolka et al. | 430/59 |
| 4,286,033 | 8/1981 | Neyhart et al. | 430/66 |

*Primary Examiner*—John E. Kittle
*Assistant Examiner*—John L. Goodrow
*Attorney, Agent, or Firm*—E. O. Palazzo

[57] ABSTRACT

This invention relates to an improved layered overcoated photoresponsive imaging device useful in a xerographic imaging process employing a single charging step, which device is comprised in the order stated of (1) a conductive supporting substrate, (2) a photoconductive composition layer, (3) a hole trapping layer, and (4) an overcoating layer comprised of a composition capable of donating electrons to positive charges contained on the surface of the photoresponsive device.

5 Claims, 2 Drawing Figures

PHOTORESPONSIVE DEVICE CONTAINING AN ELECTRON DONATING LAYER

BACKGROUND OF THE INVENTION

This invention is generally directed to an overcoated photoresponsive imaging member; and more specifically, the present invention is directed to an improved overcoated photoresponsive member which contains a trapping layer and an overcoating layer, and the use of such devices in electrostatographic imaging systems, wherein only one charging step is needed for causing the formation of images. The overcoating layer selected for the imaging member of the present invention contains a composition that is capable of transferring or donating electrons to positive corona ions on the members surface, thus allowing electrons to move upward, and positive charges to move downward towards the substrate as shown hereinafter.

Electrophotography, and in particular xerography, which involves the formation and development of images on an imaging surface, such as a photoconductive material, is well known. Numerous different types of photoreceptors have been developed for this purpose, including materials wherein the charge carrier generation and charge carrier transport function are accomplished by discrete contiguous layers. Additionally, there are known photoreceptors which include an overcoating layer of an electrically insulating polymeric material, and in conjunction with this overcoated type photoreceptor there have been proposed a number of imaging methods. Thus, for example, there has been described in U.S. Pat. No. 4,254,199 the utilization of an overcoated photoreceptor employing a double charging process that is, the photoreceptor device is subjected to charges of a positive polarity, and subsequently such devices are subjected to charges of a negative polarity. The photoreceptor device employed can be comprised of a substrate, overcoated with a hole injecting layer, which in turn is overcoated with a charge transport layer, followed by an overcoating of a charge generating layer, and finally a top overcoating layer of an insulating organic resin. This device is fully described in U.S. Pat. No. 4,251,612.

More specifically, the imaging process as described in U.S. Pat. No. '199 involves the charging of the photoresponsive device a first time with electrostatic charges of a first polarity, followed by charging a second time with electrostatic charges of polarity opposite to the first polarity, in order to substantially neutralize the charges residing on the electrically insulating surface of the device, followed by exposing the device to an imagewise pattern of activating electromagnetic radiation, whereby an electrostatic latent image is formed. The electrostatic latent image may then be developed to form a visible image, which can then be transferred to a receiving member. Subsequently, the imaging member may be reused to form additional reproductions after the erasure and cleaning steps have been accomplished.

In another known process employing overcoated photoreceptor devices, there is selected a non-ambipolar photoconductor wherein charge carriers are injected from the electrode substrate into the photoconductor surface. In such a system, in order to obtain high quality images, the injecting electrode must satisfy the requirement that it injects carriers efficiently, and uniformly into the photoconductor material.

U.S. Pat. No. 3,041,167 teaches an electrostatographic imaging method which employs an overcoated imaging member comprising a conductive substrate, a photoconductive insulating layer, and an overcoating layer of an electrically insulating polymeric material. This member is utilized in an electrostatographic copying method by, for example, initially charging the member with an electrostatic charge of a first polarity, and imagewise exposing to form an electrostatic latent image which can then be developed to form a visible image. The visible image is transferred to a receiver member, and the surface of the imaging member is cleaned to complete the imaging cycle. Prior to each succeeding cycle, the imaging member can be charged with an electrostatic charge of a second polarity, opposite in polarity to the first polarity. Sufficient additional charges of the second polarity are applied so as to create across the member a net electrical field of the second polarity. Simultaneously, mobile charges of the first polarity are created in the photoconductive layer such as by applying an electrical potential to the conductive substrate. The imaging potential, which is developed to form the visible image is present across the photoconductive layer, and the overcoating layer.

Various other imaging methods are known such as those described by Mark, in an article appearing in "Photographic Science and Engineering," Volume 18, No. 3, pages 254–261, May/June, 1974. The process referred to by Mark as the Katsuragawa and Canon processes can basically be divided into four steps. The first is step involves charging a device containing an insulating overcoating. This is normally accomplished by exposing the device to a DC corona of a polarity opposite to that of the majority charge carrier. When applying a positive charge to the surface of the insulating layer, as in the situation where an n-type photoconductor is employed, a negative charge is induced in the conductive substrate, injected into the photoconductor, and transported to and trapped at the insulating layer-photoconductive layer interface resulting in an initial potential being solely across the insulating layer. The charged plate is then exposed to a light and shadow pattern while simultaneously applying to its surface an electronic field of either alternating current (Canon) or direct current of polarity opposite that of the initial electrostatic charge (Katsuragawa). The plate is then uniformly exposed to activating radiation to produce a developable image with potential across the insulating overcoating, and to simultaneously reduce the potential across the photoconductive layer to zero. In other processes described in the Mark article, i.e., the Hall and Butterfield processes, the polarity of the initial voltage is the same sign as the majority charge carrier and reverse polarity is encountered during erase.

While the devices described in the prior art function properly and adequately under most circumstances, there continues to be a need for improved overcoated photoreceptor devices, particularly devices which contain an electron donating overcoating material, and a trapping layer, and which devices can be utilized in imaging systems employing one charging step rather than the customary two charging steps. Further, the art of electrostatography and more specifically xerography, continues to advance, and more stringent demands need to be met by the copying apparatus in order to increase performance standards, obtain higher quality images; and further there is a need for improved protective photoreceptor overcoatings. Also there is a need for improved overcoated photoresponsive devices where during the imaging process the manner in which, and the type of charges that are transported and retained at various levels of the photoreceptor device, can be controlled. Also, there continues to be a need for improved overcoated photoresponsive devices wherein an injecting layer is not needed, and wherein a single charging step can be utilized.

SUMMARY OF THE INVENTION

It is an object of the present invention to provide an improved layered photoresponsive device.

Another object of the present invention is the provision of a layered photoresponsive device containing a trapping layer, and no injecting layer.

Yet another object of the present invention is the provision of an ovecoated photoresponsive device containing a protective overcoating material which also substantially eliminates the discharge of undesirable effluents into the environment.

A further object of the present invention is the provision of an improved photoresponsive device containing in the overcoating layer a material capable of donating electrons.

Yet another important object of the present invention is the provision of an imaging process utilizing the overcoated photoresponsive device of the present invention, which process involves a single charging step.

These and other objects of the present invention are accomplished by the provision of an improved layered photoresponsive device, and a method of imaging utilizing such device wherein a single charging step is employed, the device being comprised in the following order of (1) a supporting substrate, (2) a photoconductive composition layer, (3) a trapping layer, and (4) an overcoating layer containing a material capable of donating electrons. In one important embodiment of the present invention, the layered photoresponsive device can be utilized in imaging systems wherein only a single charging step is needed, since the overcoating layer containing the material capable of donating electrons to the positive charges contained on the surface of the imaging device, allows such positive charges to in effect be neutralized on the surface, while simultaneously causing the formation of positive charges at the interface between the trapping layer and the overcoated layer.

In one preferred embodiment of the present invention, the improved layered photoresponsive device is comprised of a conductive substrate, a photogenerating layer, a trapping layer for retaining positive charges at the interface between the overcoating layer and the trapping layer, which layer also prevents these charges from migrating to the photogenerating layer, and an overcoating layer comprised of a material capable of donating or transferring electrons to positive charges contained on the surface of the photoresponsive device, which material is dispersed in a resinous binder.

BRIEF DESCRIPTION OF THE DRAWINGS

For a better understanding of the present invention and further features thereof, reference is made to the following detailed description of various preferred embodiments wherein.

DESCRIPTION OF THE PREFERRED EMBODIMENTS

Figure 1A:
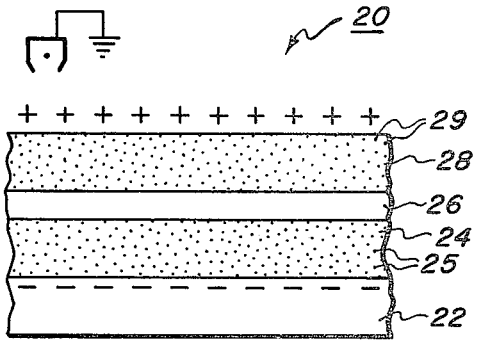
FIGS. 1*a* and 1*b* are partially schematic cross-sectional views of the photoreceptive device of the present invention.

Illustrated in FIG. 1 is the improved overcoated photoresponsive device of the present invention generally designated 20, comprising a supporting substrate 22, in contact with a photoconductive layer 24, containing a photoconductive material dispersed in a resinous binder 25, a trapping layer 26, and an overcoating layer 28, containing an electron donating material dispersed in a resinous binder 29.

The supporting substrate selected can be opaque or substantially transparent, and can be comprised of a number of suitable conductive materials having the required mechanical properties. Illustrative examples of materials that may be utilized for this layer include aluminum, brass, steel, iron, a layer of organic or inorganic material having a conductive layer arranged thereon, and other suitable conducting materials. Generally the thickness of this layer depends upon many factors including economical considerations, thus, this layer may be of substantial thickness, for example, up to 50 mils or of minimum thickness, providing there are no adverse affects on the system. In one preferred embodiment, the thickness of this layer ranges from about 3 mils to about 10 mils.

The photoconductive layer 24 can be comprised of numerous different known photoconductive materials such as selenium, selenium alloys, including selenium-arsenic, selenium-tellurium, selenium-tellurium-arsenic; halogen doped selenium materials, halogen doped selenium alloys, trigonal selenium, metal free phthalocyanines, metal phthalocyanines, vanadyl phthalocyanines, and the like, reference for example, U.S. Pat. No. 4,265,990, the disclosure of which is totally incorporated herein by reference.

Layer 24 can be of any suitable thickness, which thickness depends on a number of factors including, for example, the composition and thickness of the other layers. Typically this layer ranges in thickness of from about 0.5 microns to about 60 microns, the maximum thickness being dependent, for example, on mechanical considerations, that is whether a flexible photoreceptor is desired. Generally, the photoconductive compositions of layer 24, such as trigonal selenium are randomly dispersed in an electrically insulating organic resin 25, such as those described in U.S. Pat. No. 3,121,006, the disclosure of which is totally incorporated herein by reference. Specific examples of binder materials include polyester resins, polyamide resins, polycarbonate resins, and the like. The photoconductive material is generally present in layer 24 in an amount of at least about 10 percent by volume of the binder layer with no limitation on the maximum amount of the photoconductor material contained in the binder layer, thus this layer can be completely comprised of a photoconductive substance, and no binder material.

The hole trapping layer which is situated between the photoconductive layer 24 and the overcoating layer 28 can be comprised of numerous suitable materials, providing that this layer substantially retains positive charges at the interface between the above two mentioned layers, as the efficiency of the photoresponsive device of the present invention is adversely effected when such holes are allowed to freely migrate into the photoconductive layer. Illustrative examples of hole trapping layers include those illustrated in U.S. Pat. No. 4,291,110, the disclosure of which is totally incorporated herein by reference, such as siloxane materials, like trimethoxysilyl propylene diamine, nigrosine, the trapping layers as disclosed in U.S. Pat. No. 4,286,033, the disclosure of which is totally incorporated herein by reference, such as halogen doped selenium-arsenic alloys, and the like. One preferred hole trapping material is comprised of a halogen doped selenium-arsenic alloy wherein the percentage by weight of selenium ranges from about 95 percent to about 99.9 percent, and preferably from about 99 percent to about 99.9 percent, with the percentage of arsenic by weight varying from about 0.1 percent to about 5.0 percent, and preferably from 0.1 percent to 1 percent, the halogen being present in amounts of from about 10 parts per million to 200 parts per million, and preferably from 20 parts per million to 100 parts per million. By halogen materials is meant fluorine, chlorine, bromine and iodine with chlorine being preferred. The thickness of this layer ranges from about 0.01 microns to about 5 microns, and preferably from about 0.01 microns to about 1 micron. The minimum thickness of the hole trapping layer may be less or more, however, it must be of a thickness so as to provide for sufficient trapping of holes at the overcoating interface.

Figure 1B:
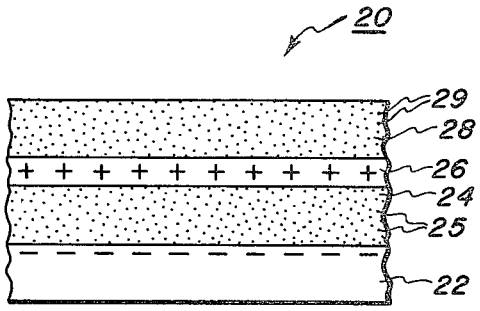

The overcoating layer 28 contains a material capable of donating electrons to the positive corotron ions contained on the surface of the device as shown, this material being dispersed in a resinous binder 29 in an amount of from about 10 percent by weight to 75 percent by weight. It is important that the electron donating material be capable of transferring electrons to the positive charges contained on the surface of the imaging device as shown in FIG. 1, wherein these charges are completely neutralized. Furthermore, such material must be capable of allowing the tranfer of electrons in the binder layer 28, thus causing positive charges to eventually form and be retained in the trapping layer 26. The condition of the photoresponsive device of the present invention subsequent to neutralization of the surface positive charges by the electron donating materials contained in layer 28 is shown in FIG. 1B wherein positive charges 30 are retained in the charge trapping layer 26 and no charges remain on the surface of the photoresponsive imaging member. Resinous binder material 29 can be comprised of the same substances as resinous binder 25.

Illustrative examples of materials capable of donating electrons, and thus useful as a component in layer 28 is comprised of those compositions of the following formula:

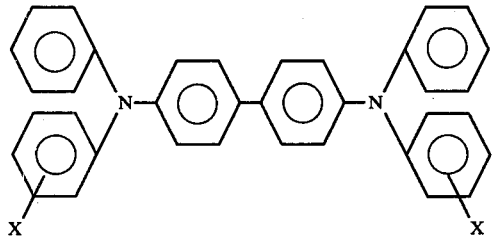

dispersed in a highly insulating and transparent organic resinous material where X is selected from the group consisting of (ortho) $CH_3$, (meta) $CH_3$, (para) $CH_3$, ortho (Cl), meta (Cl) and para (Cl). The highly insulating resin which has a resistivity of $10^{12}$ ohm-cm contains from about 10 to about 75 weight percent of the substituted N,N,N',N'-tetraphenyl[1,1'-biphenyl]4,4'-diamines corresponding to the foregoing formula.

Compounds corresponding to this formula include, for example, N,N'-diphenyl-N,N'-bis(alkylphenyl)-[1,1-biphenyl]-4,4'-diamine wherein the alkyl is selected from the group consisting of methyl such as 2-methyl, 3-methyl and 4-methyl, ethyl, propyl, butyl, hexyl and the like. In the case of chloro substitution, the compound is named N,N'-diphenyl-N,N'-bis(halo phenyl)-[1,1'-biphenyl]-4,4'diamine wherein the halo atom is 2-chloro, 3-chloro or 4-chloro.

The preferred overcoating layer component capable of donating electrons is the diamine N,N'-diphenyl-N,N'-bis(3-methylphenyl)-[1,1'biphenyl]-4,4'-diamine dispersed in an inactive binder material such as a polycarbonate resin commercially available as Makrolon® and having a molecular weight of from about 20,000 to about 100,000, with the molecular weight in the range of from about 50,000 to about 100,000 being particularly preferred.

Layer 28 generally ranges in thickness of from about 2 microns to about 30 microns, and preferably from about 5 microns to about 15 microns.

In one preferred embodiment of the present invention, the conductive substrate 22 is aluminum, the photoconductive layer 24 contains selenium, the trapping layer 26 is a selenium-arsenic alloy, wherein the percentage by weight of selenium is 99.5 percent, the percentage by weight of arsenic is 0.5 percent, which alloy has been doped with 100 parts per million of chlorine, and the overcoating layer 28 contains N,N'diphenyl-N,N'bis (3-methylphenyl)-[1,1'-biphenyl] 4-4'diamine dispersed in a polycarbonate resin.

The layered photoresponsive device of the present invention can be prepared by methods known in the art including those as described in U.S. Pat. Nos. 4,265,990, 4,286,033, and 4,291,110, the disclosure of each patent being totally incorporated herein by reference. In one illustrative embodiment, the photoresponsive device of the present invention can be prepared by first applying by vacuum evaporation the photoconductive layer 24 to the conductive supporting substrate 22. Subsequently, the hole trapping layer and the overcoating layer are then applied in a fluid form followed by evaporation of the liquid carrier selected. Upon final curing and cooling of the composite layered structure, a strong bond results between the various layers and there results a four layered device as illustrated in FIG. 1.

The electrostatic latent image formed by conventional xerographic materials in the photoresponsive device of the present invention may be developed to form a visible image by any of a number of well known xerographic development techniques including, for example, cascade development, magnetic brush development, liquid development and the like. The visible image is typically transferred to a receiver member by any conventional transfer techniques and then fixed thereto. While it is preferred to develop the electrostatic latent image with marking material, the image may be used in a host of other ways, such as, for example, reading the latent images with an electrostatic scanning system. It is important to note that the photoresponsive device of the present invention when utilized in an imaging system requires only one charging step to accomplish its objective. This is contrasted with prior art processes where similar overcoated photoresponsive devices require two charging steps and a charge injecting electrode.

Only one charging step is required when the photoresponsive device described is selected for imaging systems, since the electron donating material present in the overcoating layer 28 transfers electrons to the positively charged corona ions contained on the surface of the device, and allows the formation of positive charges at the trapping layer interface 26, as described hereinbefore, and as illustrated in FIG. 1B. More specifically, with reference to the single charging step of the present invention, as generally illustrated in FIGS. 1A and 1B the following steps are accomplished: (1) the photoresponsive device is charged positively by a corona device, followed by imagewise exposure and development by appropriate means. The developed image is then transferred and subsequently optionally permanently fused to a substrate. The residual image remaining on the photoresponsive device is then erased, and cleaned. During the charging step, positively charged corona ions are deposited on the top surface of layer 28, and the electron donating material contained in the overcoating layer 28 transfers electrons to the positive ions causing them to be neutralized. In essence, the electron donating material contained in layer 28 injects negative charges into the positive charges contained in the surface of layer 28 causing a complete neutralization of these charges. Further, in the overcoating layer 28 there is a continual donation of electrons between the electron donating molecules contained in this layer resulting in the formation of positive charges equal to the number of positive charges contained on the photoresponsive device initially, which charges are located and retained in the charge transport layer. Accordingly, this allows only one charging step as compared to two charging steps needed with similar overcoated responsive devices described in the prior art, which devices, also, in many instances, require an injecting electrode. Subsequent to the formation of the positive charges in the charge trapping layer, the imaging device is then subjected to normal xerographic imaging steps as known in the art.

In one preferred method of operation, the photoresponsive device is charged by contact charging utilizing, for example, a carbon brush, which is in contact with the overcoating layer 28 and the supporting substrate 22.

The invention will now be described in detail with respect to specific preferred embodiments thereof, it being understood that these examples are intended to be illustrative only and the invention is not intended to be limited to the materials, conditions, process parameters etc, recited therein. All percentages and parts are by weight unless otherwise indicated.

EXAMPLE I

A photoresponsive device is prepared by coating a layer of amorphous selenium, 60 microns in thickness, on an aluminum substrate, 75 microns in thickness. The coating is accomplished at a temperature of 55° C. until evaporation of the amorphous selenium is complete, which usually occurs in about 1 hour. Subsequently, there is then deposited on the amorphous selenium by vacuum evaporation, a trapping layer consisting of 97 percent by weight of selenium, and 3 percent by weight of arsenic, doped with 100 parts per million of chlorine. This layer after drying has thickness of 0.5 microns. There is then applied to the top of the trapping layer an overcoating layer comprised of 50 percent by weight of N,N'diphenyl-N,N'-bis-(3-methylphenyl)-[1,1'bi-phenyl]-4,4'-diamine dispersed in 50 percent by weight of polycarbonate resin commercially available from Mobay Chemical Company as Makrolon ®. This coating is accomplished by a draw bar coating process. Subsequent to drying at 40° C. in the vacuum oven for 16 hours, this overcoating trapping layer had a thickness of 10 microns.

The above photoresponsive device is then employed in an imaging sequence by subjecting the device to a corona charging source wherein positively charged ions are deposited on the surface of the overcoating layer, and the resulting potential is measured by a capacitively coupled probe. The device is then exposed to light of visible radiation, and the potential is again measured by a capacitively coupled probe. The zero potential measured at the end of the exposure, indicates that a zero charge remains on the surface of the photoresponsive device, that is, all the positive charges initially contained on the surface are neutralized. In contrast, when subjecting the same imaging device to the imaging process steps above, which device does not contain an electron donating material, a residual potential is measured on the surface of the imaging member by a compacitively coupled probe.

Although the invention has been described with respect to specific preferred embodiments, it is not intended to be limited thereto but rather those skilled in the art will recognize that variations and modifications may be made therein, which are within the spirit of the invention and the scope of the claims.

I claim:

1. An improved layered overcoated photoresponsive imaging device useful in a xerographic imaging process with a single charging step, which device consists essentially of (1) a conductive supporting substrate, (2) a photoconductive composition layer comprised of selenium, selenium alloys, halogen doped selenium materials, halogen doped selenium alloys, metal free phthalocyanines, metal phthalocyanies, or vanadyl phthalocyanine (3) a hole trapping layer, and (4) an overcoating layer comprised of a composition capable of donating electrons to positive charges contained on the surface of the photoresponsive device, which overcoating layer contains a dispersion of a diamine of the following formula dispersed in an insulating organic resinous binder:

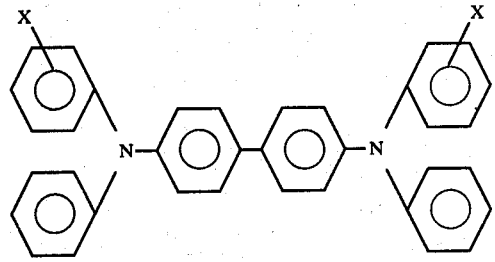

wherein X is selected from the group consisting of (ortho) $CH_3$, (meta) $CH_3$, (para) $CH_3$, ortho (Cl), meta (Cl) and para (Cl), which electron donating material is present in an amount of from about 10 percent by weight to about 75 percent by weight.

2. An improved photoresponsive device in accordance with claim 1 wherein the hole trapping layer contains a halogen doped selenium arsenic alloy wherein the percentage by weight of selenium is from about 95% to about 99.9%, and the percentage by weight of arsenic is from about 0.1% to about 5.0%.

3. An improved layered overcoated photoresponsive device in accordance with claim 1 wherein the electron donating material is N,N'-diphenyl-N,N'-bis-(3-methylphenyl)-[1,1'biphenyl]-4-diamine, and the organic resin is a polycarbonate.

4. An improved layered overcoated photoresponsive device in accordance with claim 1 wherein the conductive substrate is aluminum.

5. An improved layered overcoated photoresponsive device in accordance with claim 1 wherein the substrate has a thickness of from about 3 mils to about 10 mils, the photoconductive layer has a thickness of from about 0.5 microns to about 60 microns, the trapping layer has a thickness of from about 0.01 microns to about 5 microns, and the overcoated layer has a thickness of from about 2 microns to about 30 microns.

* * * * *